US008046868B2

(12) United States Patent
Sheddy et al.

(10) Patent No.: US 8,046,868 B2
(45) Date of Patent: Nov. 1, 2011

(54) VACUUM HAVING ACCESSORY STORAGE FEATURES

(75) Inventors: Gregg L. Sheddy, Shrewsbury, PA (US); Stuart J. Wright, Timonium, MD (US); Kathy E. DiPasquale, Baltimore, MD (US); Spencer G. Maid, Hartland, WI (US)

(73) Assignee: Black & Decker Inc., Newark, DE (US)

( * ) Notice: Subject to any disclaimer, the term of this patent is extended or adjusted under 35 U.S.C. 154(b) by 1020 days.

(21) Appl. No.: 11/870,959

(22) Filed: Oct. 11, 2007

(65) Prior Publication Data

US 2008/0115311 A1 May 22, 2008

Related U.S. Application Data

(60) Provisional application No. 60/859,945, filed on Nov. 20, 2006.

(51) Int. Cl.
*A47L 5/00* (2006.01)

(52) U.S. Cl. ..... 15/323; 15/325; 15/327.2

(58) Field of Classification Search ..... 15/323, 15/325, 327.2, 327.6, 327.7; D32/21–24; *A47L 5/00*
See application file for complete search history.

(56) References Cited

U.S. PATENT DOCUMENTS

| | | | | |
|---|---|---|---|---|
| 2,920,337 | A | | 1/1960 | Smith |
| 3,869,265 | A | | 3/1975 | Wolter et al. |
| 4,222,145 | A | | 9/1980 | Lowder |
| 5,528,794 | A | | 6/1996 | Tomasiak |
| 5,606,769 | A | | 3/1997 | Tomasiak et al. |
| D443,739 | S | | 6/2001 | Young et al. |
| D446,612 | S | | 8/2001 | Kohler et al. |
| D447,609 | S | * | 9/2001 | Hult et al. ..... D32/31 |
| D467,694 | S | | 12/2002 | Kitts |
| 6,494,544 | B1 | * | 12/2002 | Berfield et al. ..... 301/111.01 |
| 6,510,583 | B2 | | 1/2003 | Griffin et al. |
| 6,530,116 | B2 | * | 3/2003 | Berfield et al. ..... 15/328 |
| 6,938,299 | B2 | * | 9/2005 | Martinez et al. ..... 15/323 |
| D521,700 | S | | 5/2006 | Griffin |
| D528,255 | S | | 9/2006 | Griffin et al. |
| 7,237,300 | B2 | | 7/2007 | Tomasiak et al. |
| 2005/0055794 | A1 | | 3/2005 | Marshall et al. |

FOREIGN PATENT DOCUMENTS

| | | |
|---|---|---|
| EP | 0607058 | 7/1994 |

* cited by examiner

*Primary Examiner* — David Redding

(74) *Attorney, Agent, or Firm* — Harness, Dickey & Pierce, P.L.C.

(57) ABSTRACT

A vacuum including a housing, a suction device disposed within the housing, a plurality of accessories operable to engage the suction device, a plurality of wheels mounted to the housing and at least one bumper disposed on the housing. The at least one bumper includes a retaining feature operable to store at least one of the accessories, and the at least one bumper is operable to protect at least one of the wheels to minimize damage thereto. At least one pocket is defined by the bumper. The pocket is adapted to store at least one of the accessories.

13 Claims, 5 Drawing Sheets

VACUUM HAVING ACCESSORY STORAGE FEATURES

CROSS-REFERENCE TO RELATED APPLICATIONS

This application claims the benefit of U.S. Provisional Application No. 60/859,945, filed on Nov. 20, 2006. The disclosure of the above application is incorporated herein by reference.

FIELD

The present disclosure relates to vacuums, and in particular, to a vacuum with accessory storage features.

BACKGROUND

The statements in this section merely provide background information related to the present disclosure and may not constitute prior art.

Many vacuum cleaners, especially shop vacuums, include a variety of accessories that may be attached to the vacuum to aid in the collection of waste matter. These accessories may include extensions to increase the reach of the vacuum, and a variety of nozzles and other attachments shaped to facilitate vacuuming on various surfaces and in tight spaces.

Typically, vacuums do not include satisfactory storage means for idle accessories. These vacuums fail to securely retain accessories in a space efficient manner. Accessories often must be stored separately from the vacuum, which requires the user to interrupt vacuuming to retrieve the accessories as needed.

SUMMARY

A vacuum including a housing, a suction device disposed within the housing, a plurality of accessories operable to engage the suction device, a plurality of wheels mounted to the housing and at least one bumper disposed on the housing. The at least one bumper includes a retaining feature operable to store at least one of the accessories, and the at least one bumper is operable to protect at least one of the wheels to minimize damage thereto. At least one pocket is defined by the bumper. The pocket is adapted to store at least one of the accessories.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
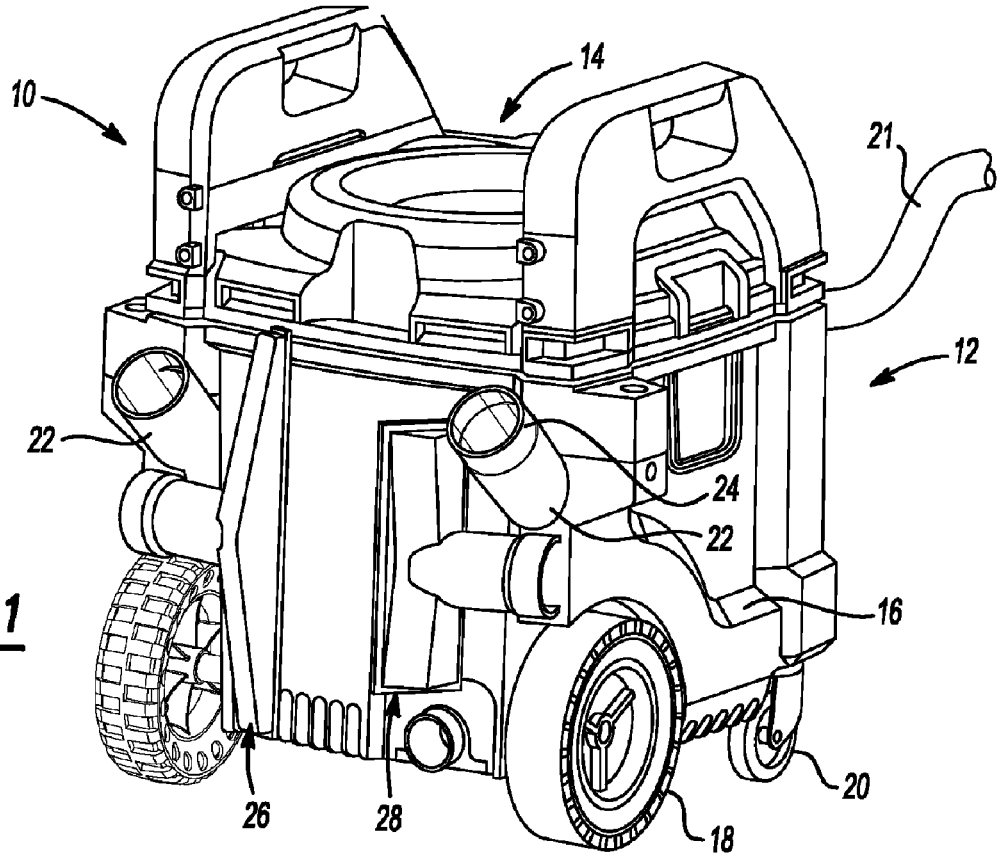
FIG. 1 is a perspective view of a vacuum according to the principles of the present disclosure.
Figure 2:
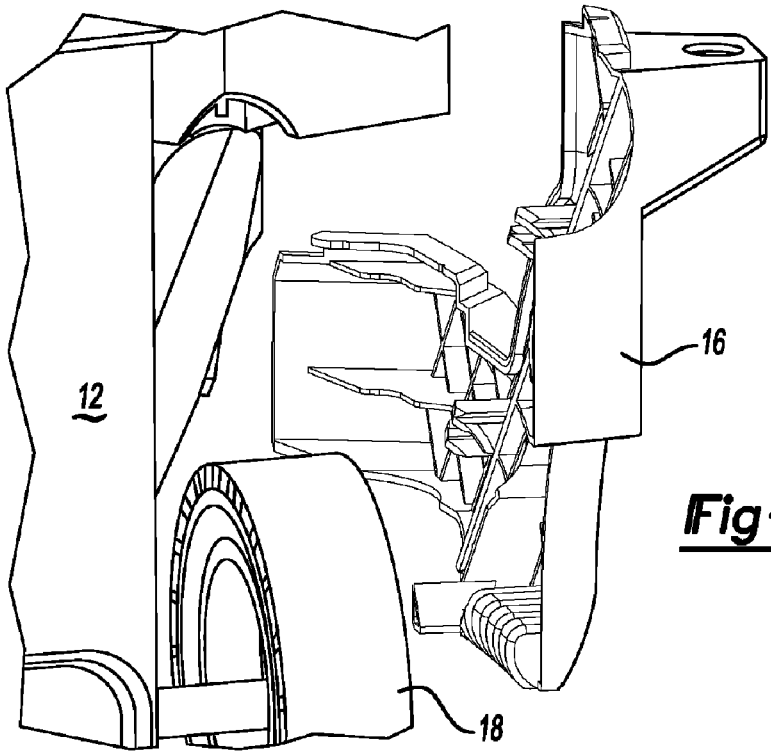
FIG. 2 is a partially exploded perspective view illustrating a bumper according to the principles of the present disclosure.

The following description is merely exemplary in nature and is not intended to limit the present disclosure, application, or uses. It should be understood that throughout the drawings, corresponding reference numerals indicate like or corresponding parts and features.

Referring to FIGS. 1-6, a vacuum with accessory storage features is shown, and is generally referred to as vacuum 10. Vacuum 10 includes a housing 12 that encloses a suction device. The suction device is generally located within housing 12 at 14, and includes a mechanism that creates a suction force operable to collect dirt, debris, and other wet or dry waste matter, as known in the art. For example, suction device 14 may include an electric motor driving a suction impeller (not shown).

Housing 12 may include one or more bumpers 16. Vacuum 10 may include a plurality of wheels 18 and/or one or more caster wheel 20 to facilitate mobility and maneuverability. Bumpers 16 may extend laterally from housing 12 so as to be operable to shield wheels 18 and/or caster wheels 20 from damaging impacts and/or debris.

Suction device 14 provides a suction force to a flexible vacuum hose 21 extending from the housing, which may be adapted to receive a variety of accessories, such as extension wands 22, crevasse tool 24, floor nozzles 26, 28, and other attachments. Extension wands 22 may be in fluid communication with suction device 14 to extend the functional reach of vacuum 10 during operation. Crevasse tool 24 and floor nozzles 26, 28 may be in fluid communication with suction device 14 to facilitate efficient vacuuming over a variety of surfaces and in restricted spaces. Any of floor nozzles 26, 28 and crevasse tool 24 may be used in conjunction with extension wands 22 or independently therefrom.

Figure 3:
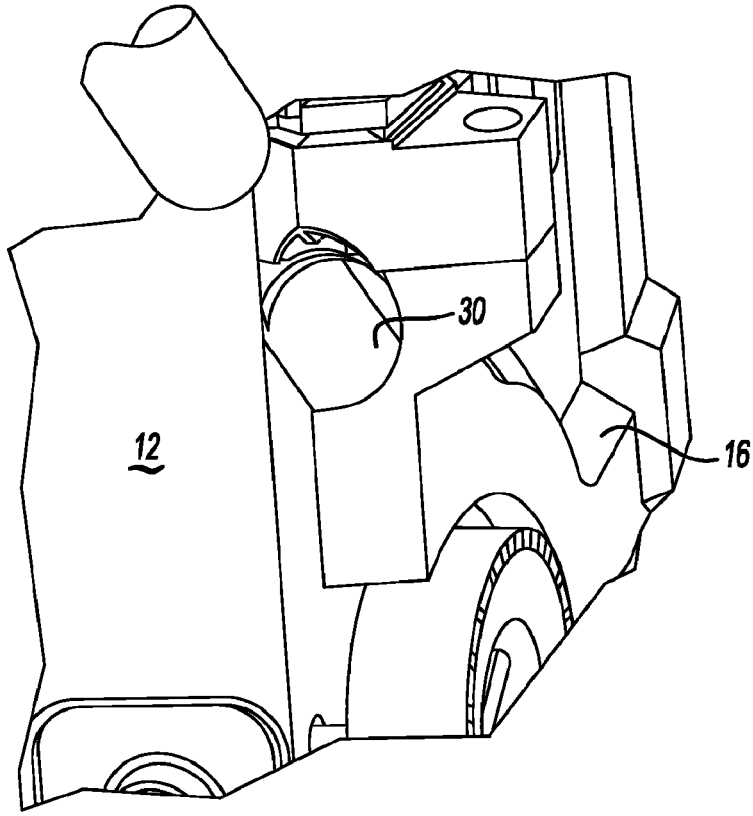
FIG. 3 is a partial perspective view illustrating the pocket shown in FIG. 1.
Figure 4:
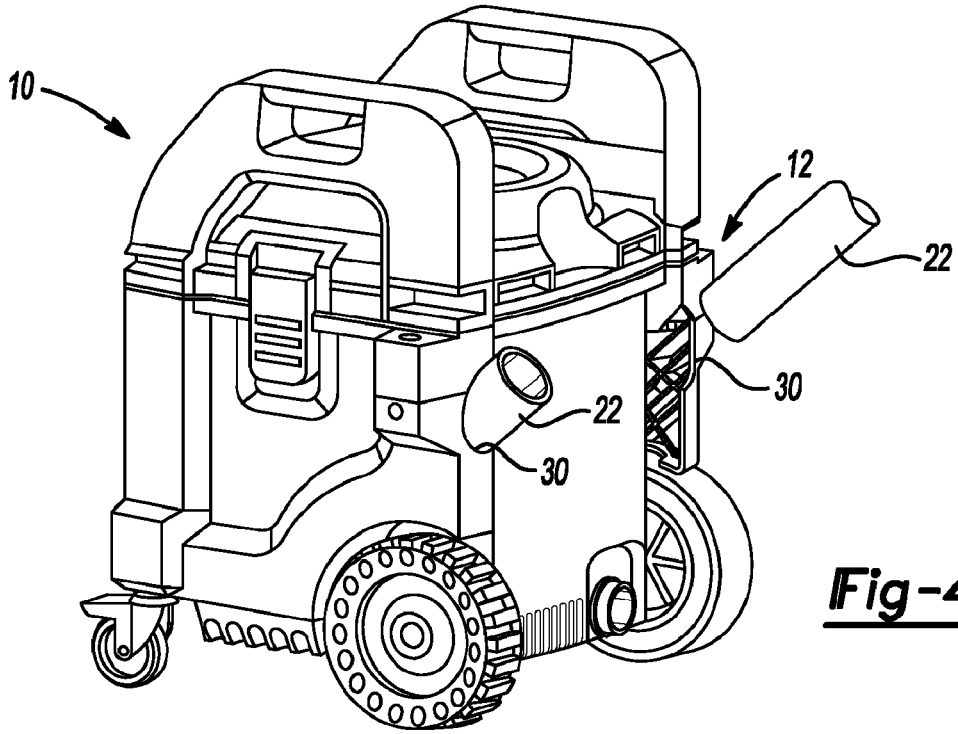
FIG. 4 is a partially exploded perspective view of the vacuum according to the principles of the present disclosure.

In an exemplary embodiment, vacuum 10 can include a plurality of bumpers 16 fixedly mounted to housing 12 or integrally formed with housing 12. As best shown in FIG. 3, bumper 16 may be configured to provide a pocket 30. Pocket 30 is adapted to slidably receive and retain extension wand 22, as shown in FIG. 4. In this manner, a substantial portion of extension wand 22 may be stored within the profile of bumper 16, minimizing the overall footprint of vacuum 10.

Figure 5:
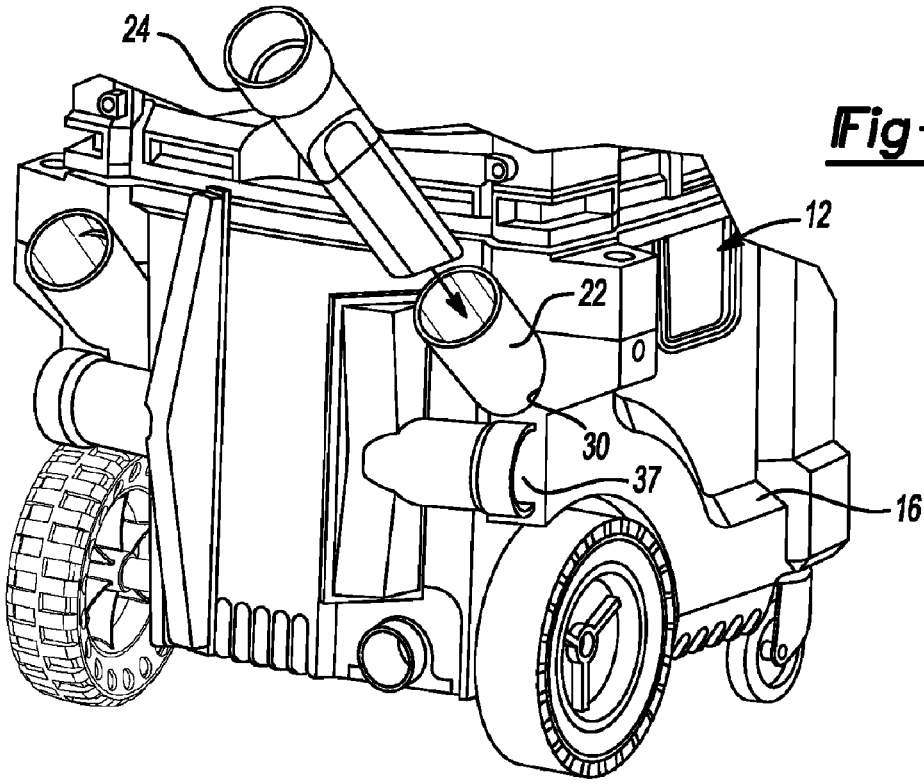
FIG. 5 is a partially exploded perspective view illustrating the crevasse tool shown in FIG. 1.

Crevasse tool 24 may be slidably received within extension wand 22, as shown in FIG. 5. Alternatively, crevasse tool 24 may be slidably engaged directly with pocket 30, and may be stored therein when not in use. In an alternative embodiment, bumper 16 may be adapted to slidably receive floor nozzles 26, 28 within pocket 30.

Figure 6:
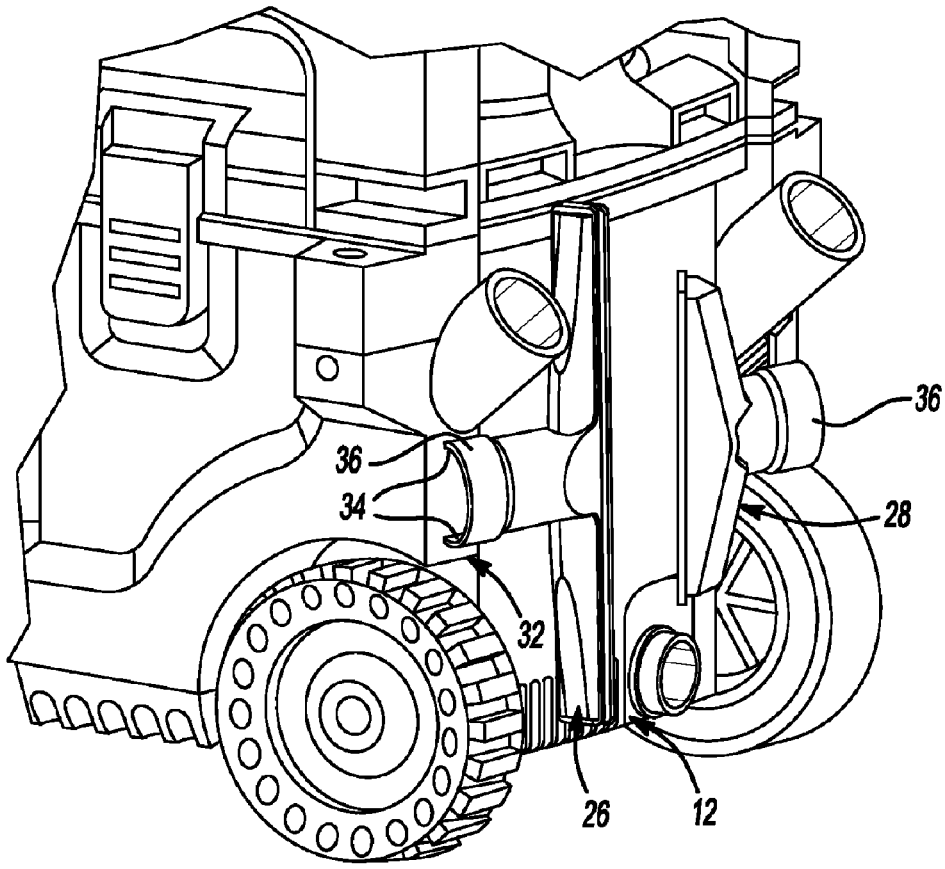
FIG. 6 is a partial perspective view of the vacuum according to the principles of the present disclosure.

As shown in FIG. 6, bumper 16 may also include retention feature 32 adapted to retain floor nozzle 26 or 28. Retention feature 32 may include one or more slots 34. A stem 36 of floor nozzle 26, 28 may be slidably received within slots 34, and the friction therebetween may retain the floor nozzle 26, 28 therein. In this manner floor nozzles 26, 28 may be stored substantially flush to housing 12 to minimize the overall footprint of vacuum 10.

Alternatively, retention feature 32 may include a protrusion 37, as shown in FIG. 5, whose width is substantially equal to the inner diameter of stem 36. Stem 36 may be slidably engaged with the protrusion 37. The friction between stem 36 and the protrusion 37 may retain the floor nozzle 26, 28 to the protrusion 37.

Accessories including, for example, extension wands 22, crevasse tool 24, and floor nozzles 26, 28 may be stored substantially as shown in FIG. 1 while vacuum 10 is in operation. In this manner, a plurality of accessories are conveniently accessible, yet space-consciously and securely retained.

Figure 7:
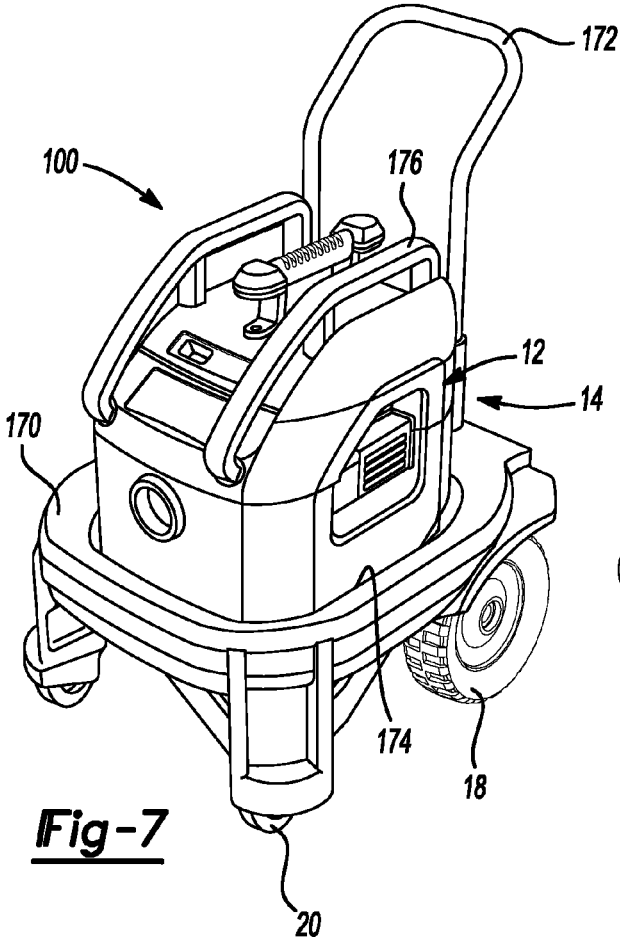
FIG. 7 is a perspective view of a vacuum according to an alternative embodiment of the present disclosure.
Figure 8:
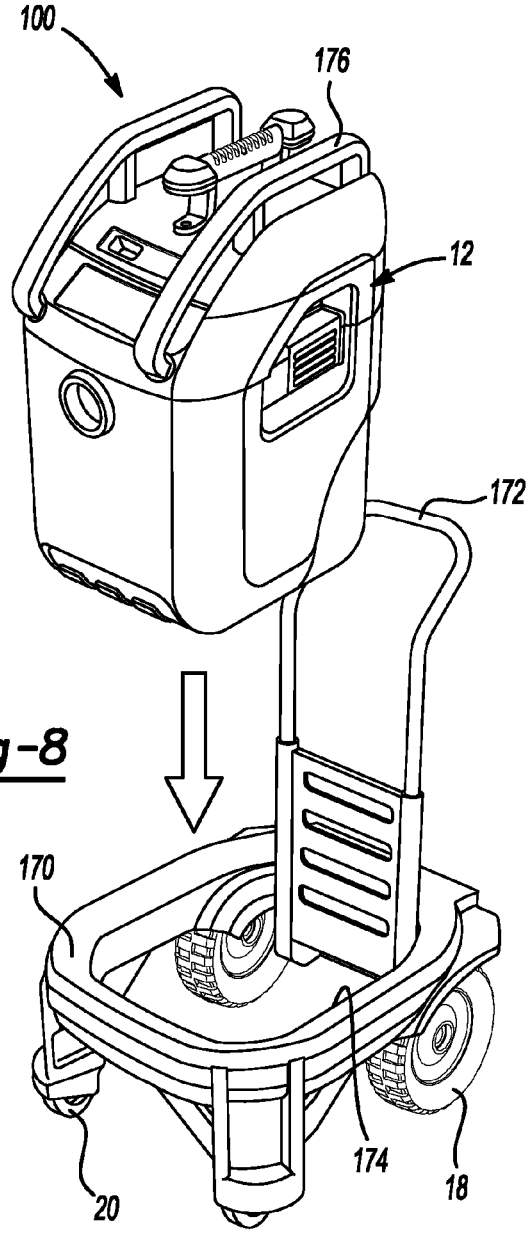
FIG. 8 is a partially exploded perspective view of a vacuum according to an alternative embodiment of the present disclosure.
Figure 9:
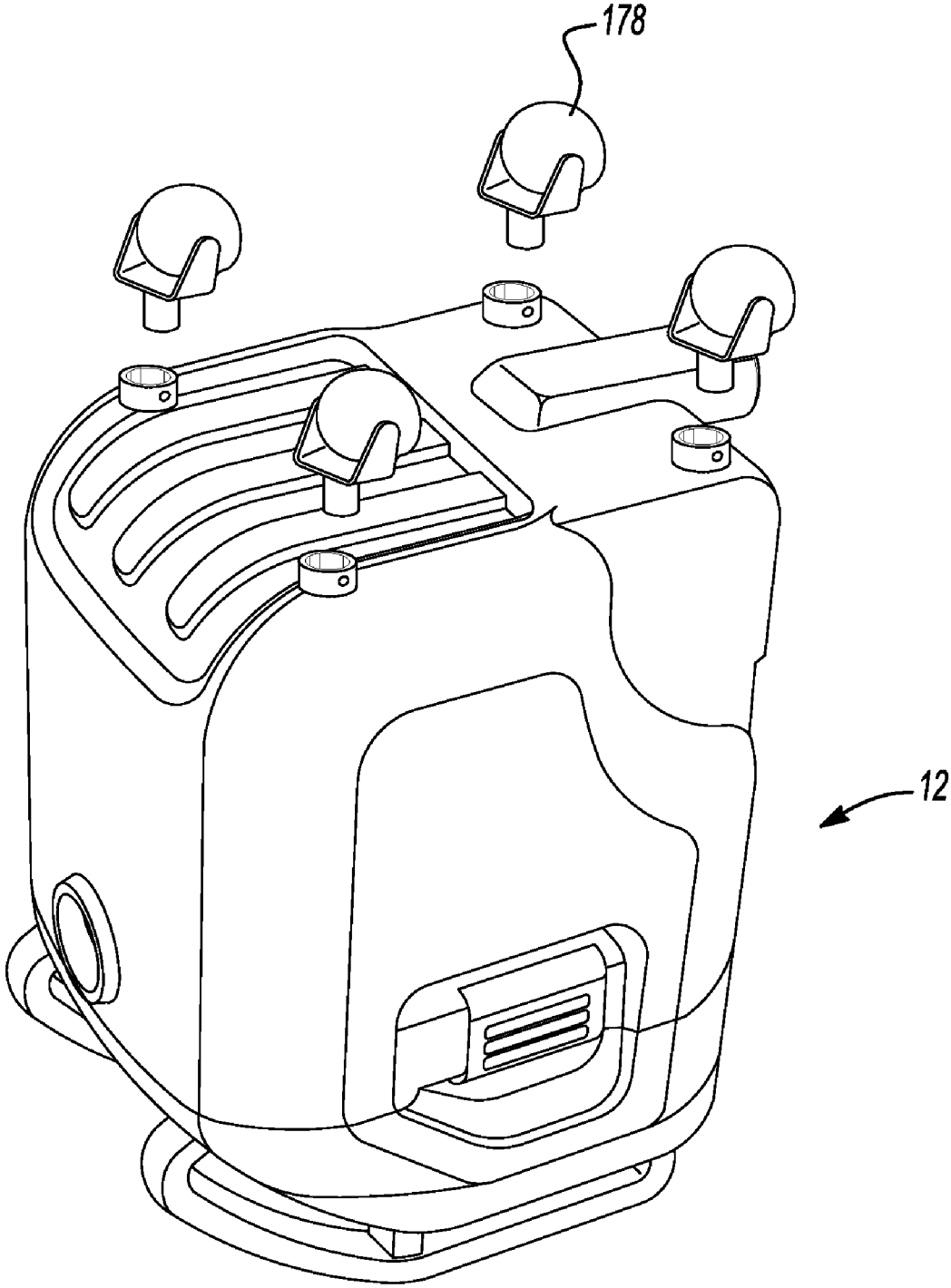
FIG. 9 is a partially exploded bottom perspective view of the housing according to an alternative embodiment of the present disclosure.

With reference to FIGS. 7-9, wherein common reference numerals are used to represent common elements as disclosed in FIGS. 1-6, an alternative embodiment is shown. Vacuum 100 includes a housing 12, an internal suction device 14, and a frame 170. Frame 170 may include a handle 172 and a plurality of wheels 18 and/or caster wheels 20. Frame 170 may also include accessory storage features (not shown) such as those provided in bumpers 16, as described above.

In an exemplary embodiment, frame 170 may include a plurality of relatively larger wheels 18 and relatively smaller caster wheels 20. The caster wheels 20 are pivotable to facilitate steering and maneuverability of vacuum 100. It should be appreciated that the number and arrangement of wheels 18 and/or caster wheels 20 may be varied to facilitate stability and maneuverability.

Handle 172 may be utilized to apply pushing and pulling forces to cause movement of vacuum 100. An operator may apply a downward force to handle 172 to cause caster wheels 20 to be lifted off of the ground or floor. Thus causing vacuum 100 to be in direct contact with the ground or floor surface only through wheels 18. In this manner, vacuum 100 may be pushed or pulled to freely travel over job site impediments.

Housing 12 is disposed within an aperture 174 of frame 170. Aperture 174 and a bottom portion of housing 12 may be tapered downward to limit the distance through which housing 12 may be inserted. Alternatively, housing 12 may be disposed within aperture 174 and may be supported therein by a cross-member (not shown). In still other embodiments, housing 12 may be mounted to frame 170 via conventional fastening methods such as latches, clips, bolts, pins, or straps.

As shown in FIG. 8, housing 12 may be lifted and removed from frame 170. Housing 12 may include one or more handles 176 to facilitate lifting and removal of housing 12. Housing 12 may be repeatedly engaged and disengaged with frame 170 as desired. Vacuum 100 may be operated while housing 12 is disposed within frame 170. Alternatively, vacuum 100 may be operated independently from frame 170. Housing 12 may be disengaged from frame 170 to empty waste matter collected during operation. Housing 12 may also be disengaged from frame 170 to reduce the space occupied by vacuum 100 to promote ease of use and/or maneuverability in a space-limited environment.

As shown in FIG. 9, vacuum 100 may include a plurality of auxiliary wheels 178. Auxiliary wheels 178 may be pivotably engaged within housing 12. Auxiliary wheels 178 facilitate mobility and maneuverability while housing 12 is disengaged from frame 170. When engaged with frame 170, housing 12 may be sufficiently spaced from the ground or floor so that auxiliary wheels 178 do not contact the ground or floor. It should be appreciate that the number and configuration of auxiliary wheels 178 may be varied to facilitate stability and maneuverability.

The description of the present disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A vacuum comprising:

a housing;

a suction device disposed within said housing at least one attachment, wherein said suction device is adapted for fluid communication with said at least one attachment;

at least one bumper; and at least one pocket defined in part by said at least one bumper and in part by an exterior surface of said housing, wherein said pocket is operable to retain a portion of said at least one attachment within the profile of said bumper.

2. The vacuum according to claim 1, wherein said at least one bumper is mounted to said exterior surface of said housing and extending laterally from said housing so as to be operable to shield a wheel mounted to said housing.

3. The vacuum according to claim 1, wherein said at least one bumper is adapted to retain a floor nozzle disposed against said housing.

4. The vacuum according to claim 1, wherein said at least one attachment is adapted to slidably engage said at least one pocket.

5. The vacuum according to claim 1, wherein said at least one attachment is at least one of an extension wand, a floor nozzle, or a crevasse tool.

6. The vacuum according to claim 1, wherein said at least one attachment is a crevasse tool adapted to be stored within at least one of an extension wand and said at least one pocket.

7. A vacuum accessory retention system comprising:

a housing;

at least one bumper disposed on said housing, wherein at least one pocket is defined by said at least one bumper;

said at least one pocket is adapted to receive at least one accessory;

a floor nozzle including a hose engagement portion with a center axis and a floor engaging portion extending laterally from said center axis of said hose engagement portion; and said at least one bumper includes a retention feature adapted to directly support said hose engagement portion of said floor nozzle so that said center axis of said hose engagement portion is horizontal.

8. The vacuum accessory retention system according to claim 7, wherein a portion of said at least one accessory is retained within a profile of said bumper.

9. The vacuum accessory retention system according to claim 7, wherein said at least one accessory is slidably received within said bumper.

10. The vacuum accessory retention system according to claim 7, wherein said at least one bumper is fixedly mounted to said housing.

11. A vacuum comprising:

a housing;

a suction device disposed within said housing;

a plurality of accessories operable to fluidly communicate with said suction device;

a plurality of wheels mounted to said housing;

at least one bumper disposed on said housing, wherein said at least one bumper includes a retention feature operable to store at least one of said plurality of accessories, and at least one of said at least one bumper is operable to protect at least one of said wheels to minimize damage thereto; and at least one pocket defined by said at least one bumper, wherein said pocket is adapted to store at least one of said accessories having a longitudinal axis diagonally disposed directly above said at least one of said plurality of wheels.

12. The vacuum according to claim 11, wherein said plurality of accessories include at least one of an extension wand, a floor nozzle, or a crevasse tool.

13. The vacuum according to claim 11, wherein a portion of each of said plurality of accessories are retained within a profile of said at least one bumper to reduce an overall footprint of the vacuum.

* * * * *

UNITED STATES PATENT AND TRADEMARK OFFICE

CERTIFICATE OF CORRECTION

PATENT NO. : 8,046,868 B2
APPLICATION NO. : 11/870959
DATED : November 1, 2011
INVENTOR(S) : Gregg L. Sheddy et al.

It is certified that error appears in the above-identified patent and that said Letters Patent is hereby corrected as shown below:

Column 4

Line 13, after "housing" insert -- ; --.

Line 13, begin new paragraph with "at least one".

Signed and Sealed this
Twentieth Day of December, 2011

David J. Kappos

David J. Kappos
*Director of the United States Patent and Trademark Office*